US006425590B1

(12) United States Patent
Whiteside et al.

(10) Patent No.: US 6,425,590 B1
(45) Date of Patent: Jul. 30, 2002

(54) COMBINATION MECHANIC'S CREEPER AND CHAIR

(75) Inventors: Kirt E. Whiteside, Marion; Terry L. Whiteside, Delaware, both of OH (US)

(73) Assignee: Whiteside Mfg. Co., Delaware, OH (US)

( * ) Notice: Subject to any disclaimer, the term of this patent is extended or adjusted under 35 U.S.C. 154(b) by 0 days.

(21) Appl. No.: 09/587,604

(22) Filed: Jun. 5, 2000

Related U.S. Application Data

(63) Continuation-in-part of application No. 09/511,251, filed on Feb. 23, 2000, now abandoned.

(51) Int. Cl.[7] ..... B25H 5/00

(52) U.S. Cl. ..... 280/32.6; 280/32.5; 297/17; 5/626

(58) Field of Search ..... 280/32.5, 32.6, 280/30; 5/626; 297/118, 17, 59

(56) References Cited

U.S. PATENT DOCUMENTS

| | | | | | |
|---|---|---|---|---|---|
| 1,394,493 | A | * | 10/1921 | Grazer | 280/32.6 |
| 2,545,336 | A | * | 3/1951 | Binder | 280/30 |
| 2,611,417 | A | * | 9/1952 | Henry et al. | 280/30 |
| 3,148,892 | A | * | 9/1964 | Merriott | 280/32.6 |
| 3,910,626 | A | * | 10/1975 | Hobbensiefken | 297/118 |
| 4,580,799 | A | * | 4/1986 | Quinonez | 280/32.6 |
| 5,261,725 | A | * | 11/1993 | Rudolph | 297/361.1 |
| D367,628 | S | * | 3/1996 | Bull | D12/128 |
| 5,572,756 | A | * | 11/1996 | Muuranen et al. | 5/626 |
| 5,611,551 | A | * | 3/1997 | Lin | 280/32.5 |
| 5,707,067 | A | | 1/1998 | Smith | 280/32.6 |
| RE35,732 | E | | 2/1998 | Shockley | 280/32.6 |
| 5,720,517 | A | * | 2/1998 | Prothro, Sr. | 297/195.11 |
| 6,095,532 | A | * | 8/2000 | Martin | 280/32.6 |
| 6,199,877 | B1 | * | 3/2001 | Shockley | 280/32.6 |

* cited by examiner

*Primary Examiner*—Robert P. Olszewski
*Assistant Examiner*—James S. McClellan
(74) *Attorney, Agent, or Firm*—Renner, Kenner, Greive, Bobak, Taylor & Weber

(57) ABSTRACT

A device (10) which can be transformed between creeper and chair configurations includes a support frame (15) which pivotally carries a first pivotal frame (16) and a second pivotal frame (17). The support frame (15) carries caster assemblies (21, 22, 23) which are positioned to render the device safely mobile in either configuration. A pad (12) is carried by the first pivotal frame (16) and serves as a headrest when the device is in the creeper configuration and a backrest when the device is in the chair configuration. A second pad (13) is hinge connected to the first and second pivotal frames (16, 17) and is maintained horizontal as it translates from the mid-body support of the creeper to a seat for the chair. A third pad (14) is carried by the support frame (15) and serves as a shelf under the second pad (13) when in the chair configuration. A latch assembly (44) automatically maintains the device (10) in the creeper configuration, and a locking assembly (51) automatically maintains the device (10) in the chair configuration. In an alternative embodiment, a device (100) includes a position control assembly (170) is operated by a handle (179) to lock the device (100) in any position from the full creeper configuration to the full chair configuration.

38 Claims, 7 Drawing Sheets

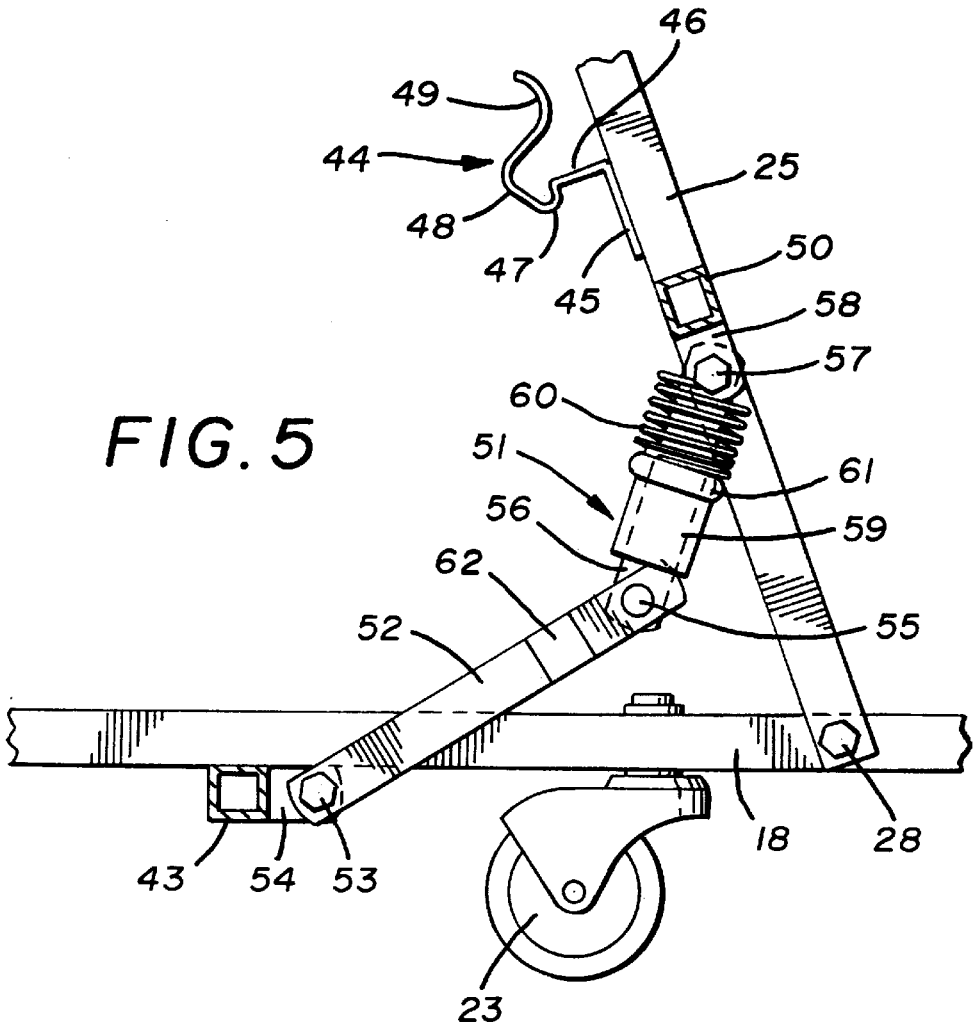
FIG. 5
FIG. 6
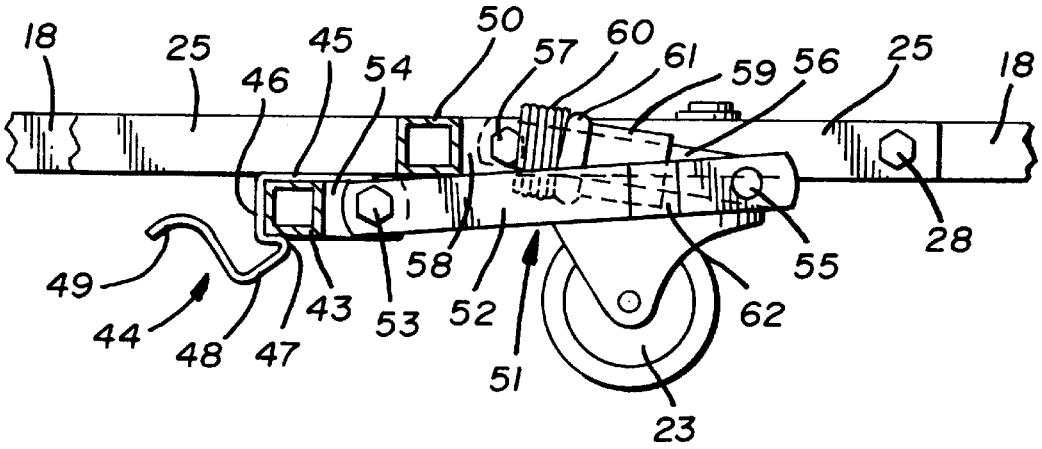

COMBINATION MECHANIC'S CREEPER AND CHAIR

CROSS-REFERENCE TO RELATED APPLICATION

This application is a continuation-in-part of U.S. patent application Ser. No. 09/511,251 filed on Feb. 23, 2000 now abandoned.

TECHNICAL FIELD

This invention relates to a creeper as used, for example, by mechanics. More particularly, this invention relates to a creeper which can readily be converted into a comfortable chair.

BACKGROUND ART

Creepers have long been used by automotive and like mechanics to assist in their work in low profile areas such as underneath the chassis of a vehicle. Typically, a body pad is carried by a frame which is provided with casters to render it mobile and allow the user, in a prone position, to maneuver himself under the vehicle. Such creepers have in the past served, and continue to readily serve, their users in working underneath vehicles and other devices. However, the mechanic at times may be working on other areas of the vehicle where he would be most comfortable being seated, and to that end, a line of chairs for mechanics has been successfully marketed. Nevertheless, the fully-equipped mechanic is required to bear the expense and inconvenience of having two items, a creeper and a chair, to most conveniently and comfortably perform his tasks.

Faced with this problem, there have been some attempts to provide a creeper which may be maneuvered to establish a seating surface. One such device is shown in U.S. Pat. No. Re. 35,732. In that patent, to convert a creeper to a seat, first all of the padding but the headrest must be removed from the creeper. Then the portion of the creeper having the headrest and two of the casters is pivoted relative to the rest of the creeper until stop pins are engaged. The headrest thereby forms a seat. While thus providing a seat for the user, this device has its drawbacks, one of which is its stability and safety. In the seat configuration, it is supported only by four casters with the seat being somewhat forward of, rather than centrally located over, those casters. Moreover, a forward shifting of the weight of the user while seated could permit the seat to begin collapsing back to the creeper configuration inasmuch as it is not locked in the seat position but rather is merely resting on small pins. In this regard, safety could also be a factor because the entire weight of the user is supported by these pins. Finally, this device provides no degree of comfort for the user in that there is no back support as would be provided by a chair as opposed to a simple seat.

One commercial embodiment of U.S. Pat. No. Re. 35,732 manufactured by Excalibur Tool & Equipment Co., Inc. of Greenville, S.C., attempts to solve some of the drawbacks of the device shown in the patent. However, this device still supports the weight of the user on a small surface area and is also quite cumbersome to convert from a creeper to a chair. Moreover, a latch which laterally protrudes from the creeper frame is provided to maintain the device in the desired configuration. However, this laterally protruding latch could constitute an obstruction for the facile movement of the creeper in a confined area.

Another convertible creeper device is shown in U.S. Pat. No. 5,707,067. This device is mechanically complex in that a slide mechanism must be provided to slide end portions of a creeper toward each other while raising the central portion of the creeper to form a seat. Such a device is not only expensive to manufacture, but difficult to use, and it too does not provide comfort or stability for the user.

The need exits, therefore, for an economically manufacturable creeper which can be easily converted to a comfortable chair which can be safely and stably utilized.

DISCLOSURE OF THE INVENTION

It is thus an object of the present invention to provide a combination creeper and chair device.

It is another object of the present invention to provide a device, as above, which is easily and automatically converted from a creeper or chair to a chair or creeper, respectively.

It is a further object of the present invention to provide a device, as above, which is stable and safe both in the creeper and in the chair configuration.

It is an additional object of the present invention to provide a device, as above, which can be conveniently and automatically locked and maintained in the creeper configuration and yet be readily detached to be transformed to the chair configuration.

It is yet another object of the present invention to provide a device, as above, which can be conveniently and automatically locked and maintained in the chair configuration and yet be readily detached to be transformed to the creeper configuration.

It is still another object of the present invention to provide a device, as above, which can be conveniently and automatically locked in the full creeper configuration, in the full chair configuration, or in any position between the full creeper configuration and the full chair configuration.

It is a still further object of the present invention to provide a device, as above, in which the headrest in the creeper configuration is automatically converted to a back rest in the chair configuration.

These and other objects of the present invention, as well as the advantages thereof over existing prior art forms, which will become apparent from the description to follow, are accomplished by the improvements hereinafter described and claimed.

In general, in accordance with one aspect of the present invention, a device which is transformable between a full creeper configuration and a full chair configuration includes a first frame which pivotally carries a second frame. The device includes means which are pivotally connected between the first and second frames to allow movement of the second frame relative to the first frame to configure the device anywhere from the full creeper configuration to the full chair configuration.

In accordance with another aspect of the present invention, a position control assembly is connected between the first frame and the second frame. Upon actuation of the position control assembly, the second frame may pivot relative to the first frame to configure the device in any desired configuration.

A preferred exemplary combination creeper and seat device incorporating the concepts of the present invention is shown by way of example in the accompanying drawings without attempting to show all the various forms and modifications in which the invention might be embodied, the invention being measured by the appended claims and not by the details of the specification.

BRIEF DESCRIPTION OF THE DRAWINGS

FIG. 5 is a partially sectioned, fragmented, side elevational view particularly showing the mechanism by which the device is automatically locked in the chair configuration in a position during the time when the device is being transformed from the creeper configuration to the chair configuration.

FIG. 6 is a partially sectioned, fragmented, side elevational view particularly showing the mechanism shown in FIG. 5 in a position when the device is in the creeper configuration and showing the manner in which the device is maintained in that configuration.

PREFERRED EMBODIMENTS FOR CARRYING OUT THE INVENTION

Figure 1:
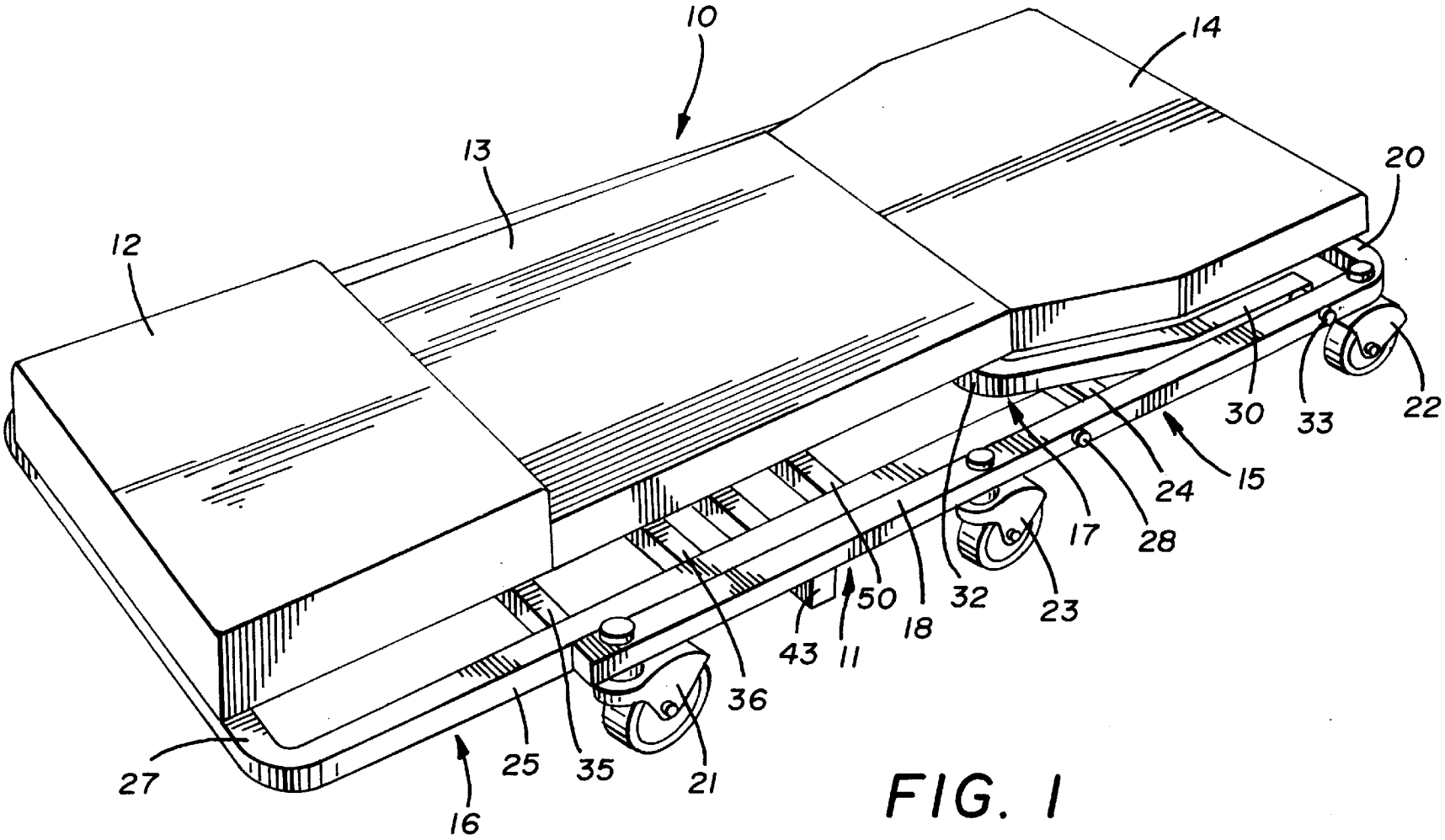
FIG. 1 is a top perspective view of the device of the present invention shown in the full creeper configuration.
Figure 2:
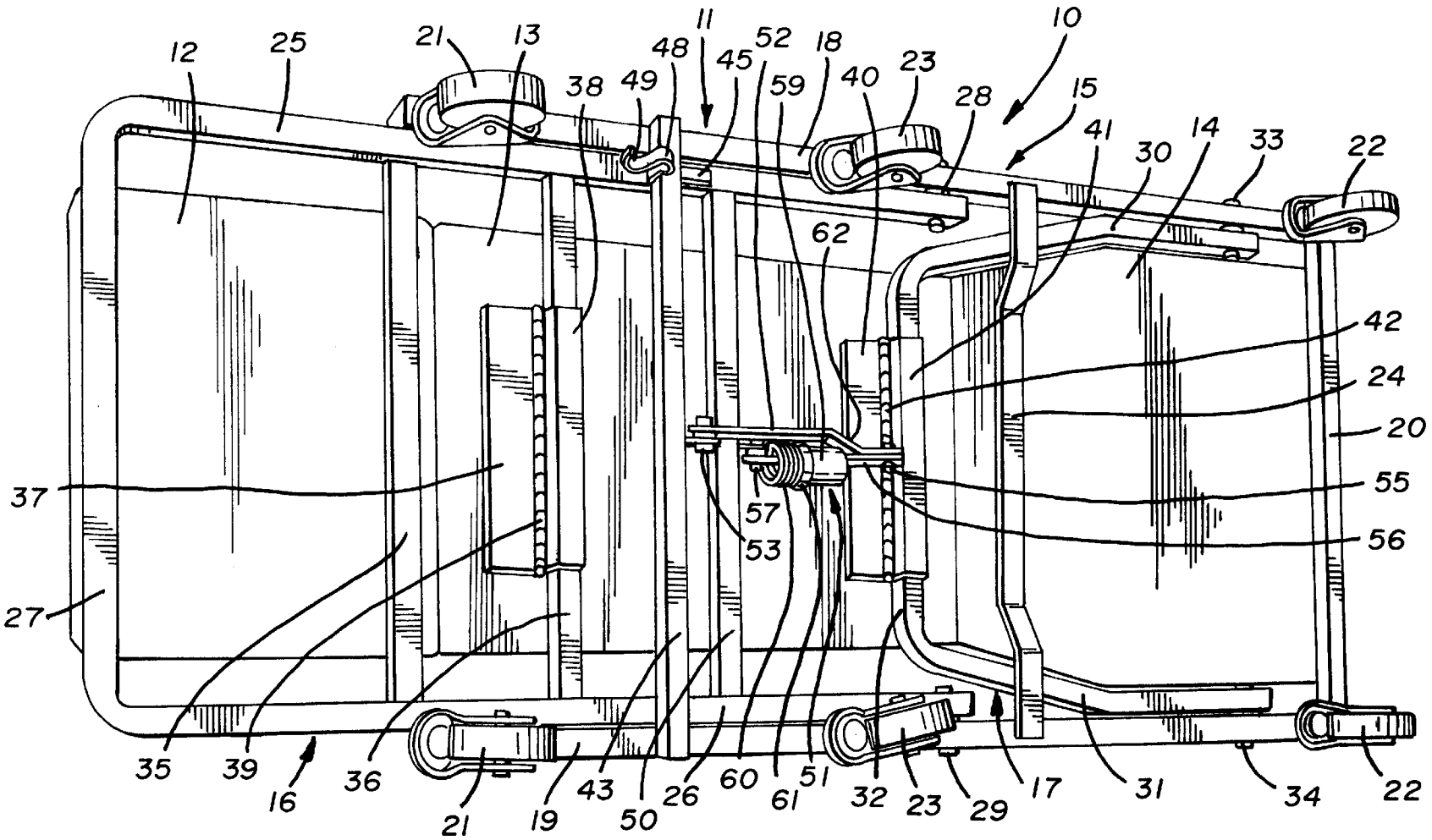
FIG. 2 is a bottom perspective view of the device of the present invention shown in the full creeper configuration.
Figure 3:
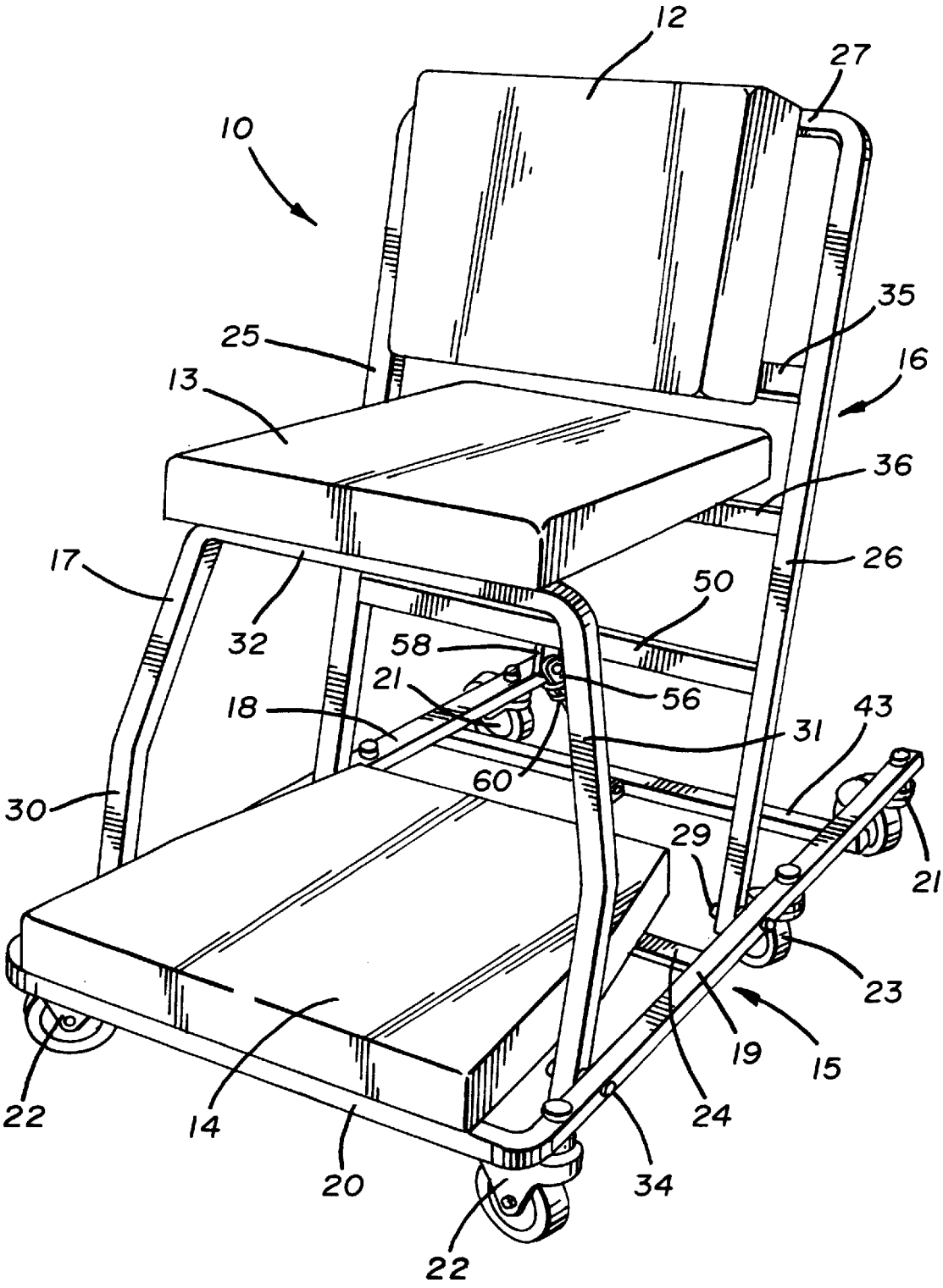
FIG. 3 is a front perspective view of the device of the present invention shown in the full chair configuration.
Figure 4:
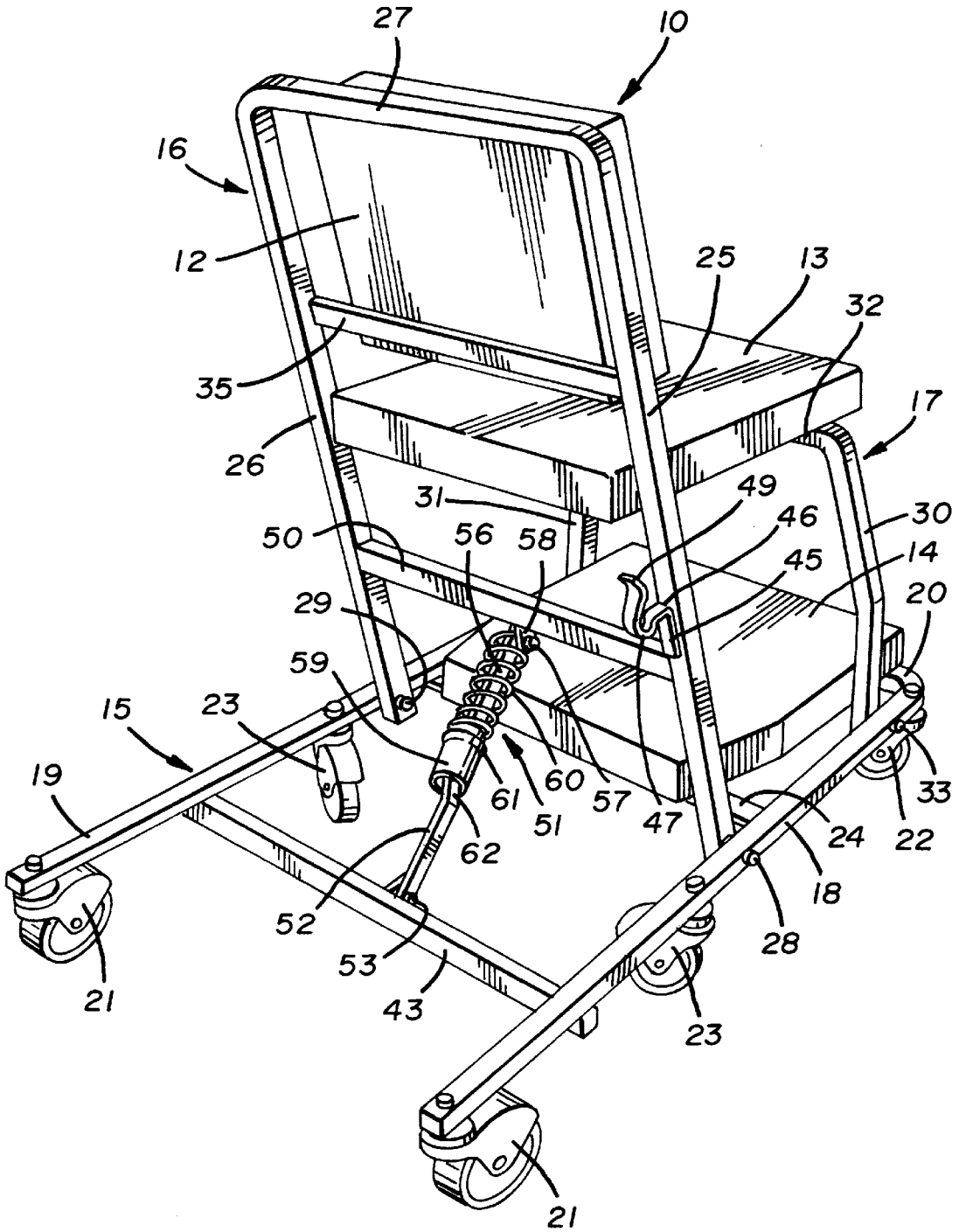
FIG. 4 is a rear perspective view of the device of the present invention shown in the full chair configuration.

A combination creeper and chair device is generally indicated by the numeral 10 and can be transformed between the creeper configuration, shown in FIGS. 1 and 2, and the chair configuration, shown in FIGS. 3 and 4. Creeper/chair 10 includes a support framework assembly generally indicated by the numeral 11 which carries three separate pads 12, 13 and 14. Pad 12 is adapted to provide a headrest when creeper/chair 10 is in the creeper configuration, and a backrest when it is in the chair configuration. Pad 13 supports the user's mid-body when in the creeper configuration, and is the seat when in the chair configuration. Pad 14 supports the user's lower body when in the creeper configuration, and in the seat configuration, it can be utilized as a shelf to carry tools or the like for the user.

Support framework assembly 11 includes a support frame generally indicated by the numeral 15, a main pivotable frame generally indicated by the numeral 16, and a secondary pivotable frame generally indicated by the numeral 17. Support frame 15 is generally U-shaped, having pair of longitudinally extending, laterally spaced arms 18 and 19 interconnected at one end by a base arm 20. Arms 18 and 19 carry a plurality of opposed pairs of caster assemblies 21, 22 and 23. A caster assembly 21 is positioned on each arm 18 and 19 near the free end thereof with another caster assembly 22 being positioned on each arm 18 and 19 at the other end thereof, that is, near base arm 20. A caster assembly 23 is carried by each arm 18 and 19 generally centrally between caster assembly pairs 21 and 22. As a result, when in the creeper configuration, caster assembly pairs 21 are located at proximate the junction of pads 12 and 13, caster assembly pairs 23 are located at proximate the junction of pads 13 and 14, and caster assembly pairs 22 are located at the end of pad 14. Caster assemblies 21, 22 and 23 thus render creeper/chair 10 mobile and stably support it when in the creeper configuration inasmuch as caster assemblies 21, 22 and 23 are positioned to support the majority of the weight of the user which is on pads 13 and 14. When in the chair configuration, seat pad 13 is generally above pad 14 and generally vertically, centrally located, over caster assemblies 22 and 23 thereby safely and stably supporting the weight of the user, with caster assemblies 21 being positioned somewhat rearwardly of backrest pad 12 for enhanced mobility when in the chair configuration.

Support frame 15 also includes a slat 24 extending laterally between arms 18 and 19 at a longitudinal position between caster assemblies 22 and 23. Pad 14 is attached to slat 24 and base arm 20 to thereby be permanently and generally horizontally positioned irrespective of whether creeper/chair 10 is in the creeper configuration or the chair configuration.

Main pivot frame 16 is generally U-shaped in configuration having laterally spaced arms 25 and 26 interconnected at one end by a cross arm 27. The other ends of arms 25 and 26 are pivotably connected to arms 18 and 19 of support frame 15, respectively, as at pivot assemblies 28 and 29, respectively. As shown, pivot assemblies 28 and 29 are longitudinally located between caster assemblies 22 and 23, nearer to caster assemblies 23.

Similarly, secondary pivot frame 17 is generally U-shaped in configuration having laterally spaced arms 30 and 31 interconnected at one end by a cross arm 32. The other ends of arms 30 and 31 are pivotably connected to arms 18 and 19 of support frame 15, respectively, as at pivot assemblies 33 and 34, respectively. As shown, pivot assemblies 33 and 34 are longitudinally located between caster assemblies 22 and 23, generally adjacent to caster assembly 22.

Main pivot frame 16 is provided with a slat 35 extending laterally between arms 25 and 26. Together with cross arm 27, slat 35 carries pad 12 so that it will be generally horizontal when creeper/chair 10 is in the creeper configuration and generally vertical when frame 16 is pivoted on pivot assemblies 28 and 29 to the chair configuration.

A crossbeam 36 also extends between arms 25 and 26 of main pivot frame 16 and is longitudinally positioned along arms 25 and 26 so that when creeper/chair 10 is in the chair configuration, it will be at the same height as cross arm 32 of secondary pivot frame 17. As such, crossbeam 36 and cross arm 32 can carry pad 13, in a manner now to be described, so that pad 13 is in a generally horizontal position when creeper/chair 10 is in both the creeper and the chair configuration. To that end, as shown in FIG. 2, a plate 37 is affixed to the bottom of pad 13 near one end thereof, and an L-shaped bracket 38 is affixed to crossbeam 36, with a hinge 39 being formed between plate 37 and bracket 38. Similarly, a plate 40 is affixed to the bottom of pad 13 near the other end thereof, and an L-shaped bracket 41 is affixed to cross arm 32, with a hinge 42 being formed between plate 40 and bracket 41. As a result, as creeper/chair 10 is transformed to and from the creeper and chair configurations, pad 13 will remain generally horizontal as pivot frames 16 and 17 move relative to pad 13 on hinges 39 and 42, respectively. Thus pivot frames 16 and 17 constitute a parallelogram linkage for pad 13.

The manner in which creeper/chair 10 is maintained in the creeper configuration and in the chair configuration will now be described in detail. Support frame 15 is provided with a support beam 43 which extends between arms 18 and 19 at a position longitudinally between caster assemblies 21 and 23. In order to maintain creeper/chair 10 in the creeper configuration, at least one of the arms 25, 26 of pivot frame 16 is provided with a locking latch assembly generally indicated by the numeral 44. Latch assembly 44 is preferably formed of spring steel and includes a base portion 45 shown as being attached to arm 25 and a beam engaging portion 46 extending laterally therefrom and terminating as a lug portion 47 extending generally parallel to base portion 45. A handle portion 48 having a finger grip area 49 is formed at the end of lug portion 47.

As arm 25 is rotated toward support frame 15 as, for example, from the FIG. 5 to the FIG. 6 position, the end of lug portion 46, that is, at the junction between handle portion 48 and lug portion 47 of latch assembly 44, contacts beam 43 and will automatically snap over beam 43 to the FIG. 6 position where beam 43 is engaged between engaging portion 46 and held in place by lug portion 47. In this condition, creeper/seat 10 will be locked in the creeper configuration. To release this engagement, the user need only utilize a finger to lift finger grip area 49 which pivots lug portion 47 clockwise, as viewed in FIG. 6, while at the same time lifting pivot frame 16 so that latch assembly 44 passes freely by beam 43 as frame 15 rotates about pivot assemblies 28 and 29. It should be appreciated that any type of latch which holds either pivot frame 16 or pivot frame 17 to support frame 15 which would accomplish the result of maintaining creeper/chair 10 in the creeper configuration is contemplated by this invention. However, it should be noted that with the particular latch assembly 44 being employed, it is positioned entirely under the profile of arm 25 such that no part thereof extends laterally outwardly from arm 25 which could snag articles of clothing or otherwise interfere with the use of the creeper/chair 10.

In order to assist in maintaining creeper/chair 10 in the chair configuration, a beam 50 extends between arms 25 and 26 of pivot frame 16 at a location longitudinally between crossbeam 36 and pivot assemblies 28 and 29. A locking assembly, generally indicated by the numeral 51, is carried between beam 43 of frame 15 and beam 50 of pivot frame 16. As best shown in FIGS. 5 and 6, locking assembly 51 includes a first link arm 52 which has one end pin connected, as at 53, to a tab 54 carried by beam 43. The other end of link arm 52 is pin connected, as at 55, to one end of a second link arm 56. The other end of link arm 56 is pin connected, as at 57, to a tab 58 carried by beam 50. A generally cylindrical tube 59 is positioned around link arm 56 and is capable of sliding relative to link arm 56. Locking assembly 51 may also be provided with a coil spring 60 which is received around link arm 56 and which extends between tab 58 and a raised collar 61 formed on tube 59.

When creeper/chair 10 is in the creeper configuration, as best shown in FIGS. 2 and 6, link arms 52 and 56 are relaxed and doubled back on each other with tube 59 fitting loosely around link arm 56. The subsequent pivotable movement of arms 25 and 26 of pivot frame 16 relative to arms 18 and 19 of support frame 15 causes link arms 52 and 56 to begin pivoting on pins 53, 55 and 57, as shown in FIG. 5. Continued pivotal movement of frame 16 generally aligns link arms 52 and 56 at which time tube 59 is moved by spring 60 until it hits a stop surface formed by a bend 62 (FIGS. 2 and 4) in link arm 52. As such, tube 59 is automatically positioned over the pin connection 55 between link arms 52 and 56 thereby prohibiting them from pivoting relative to each other and therefore maintaining creeper/chair 10 in the chair configuration as shown in FIG. 2. It should be appreciated that the locking action of locking, assembly 51, as just described, is automatic, without any special intervention of the user. In fact, spring 60 only assures that tube 59 will be properly positioned inasmuch as tube 59 will most often properly position itself against the stop surface of bend 62 under the influence of gravity. Thus, spring 60 may not be necessary but is preferably present to assure the proper placement of tube 59 over pin connection 55. It should also be evident that to release locking assembly 51, so that creeper/chair 10 can be returned to the creeper configuration, one need only grasp tube 59 and slide it along link arm 56 against the bias of spring 60 to expose pin connection 55, at which time, with just a light downward (as viewed in FIG. 5) pressure at the area of pin connection 55, arms 25 and 26 of pivot frame 16 may be rotated counterclockwise toward support frame 15.

Figure 7:
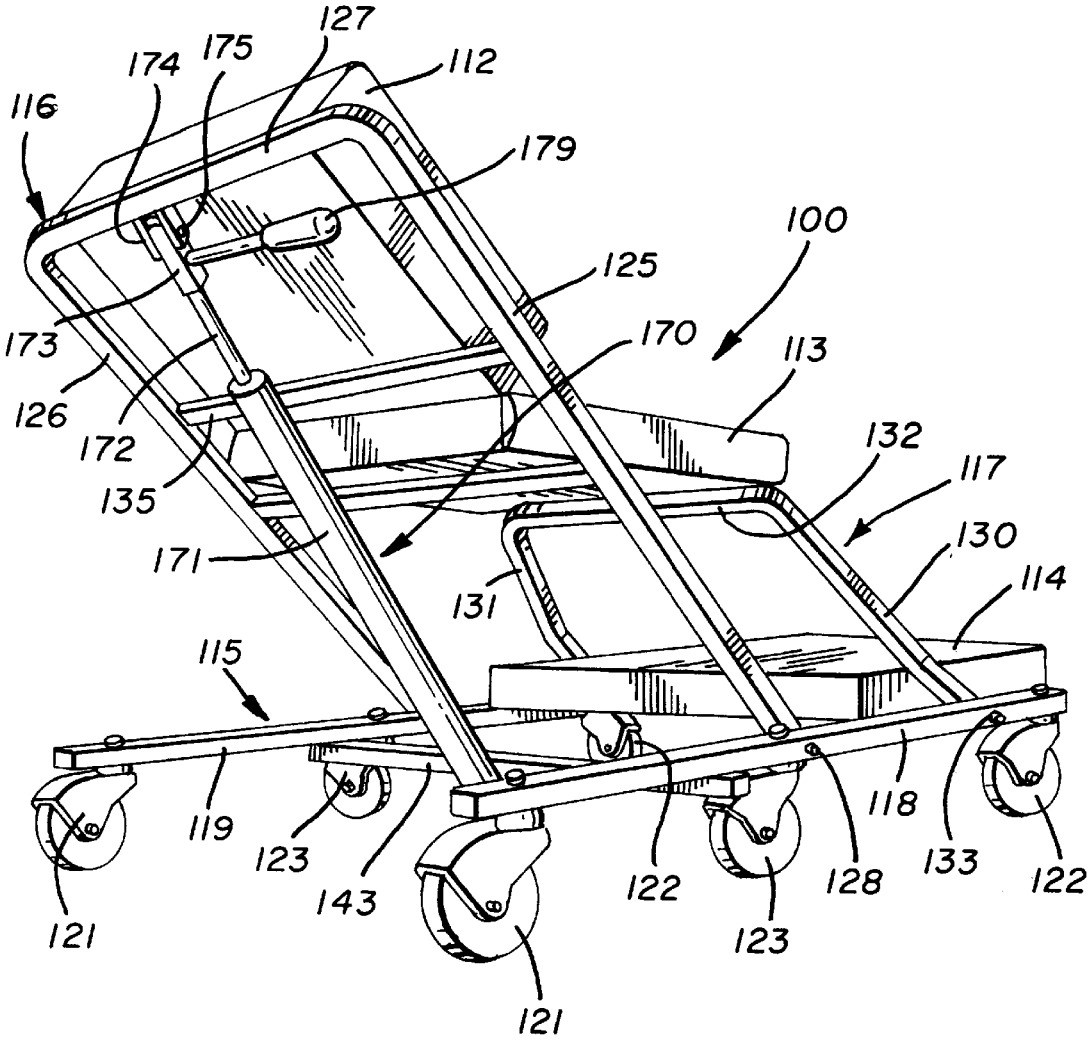
FIG. 7 is a rear perspective view of an alternative embodiment of the present invention showing this embodiment in a position between the full creeper configuration and the full chair configuration.
Figure 8:
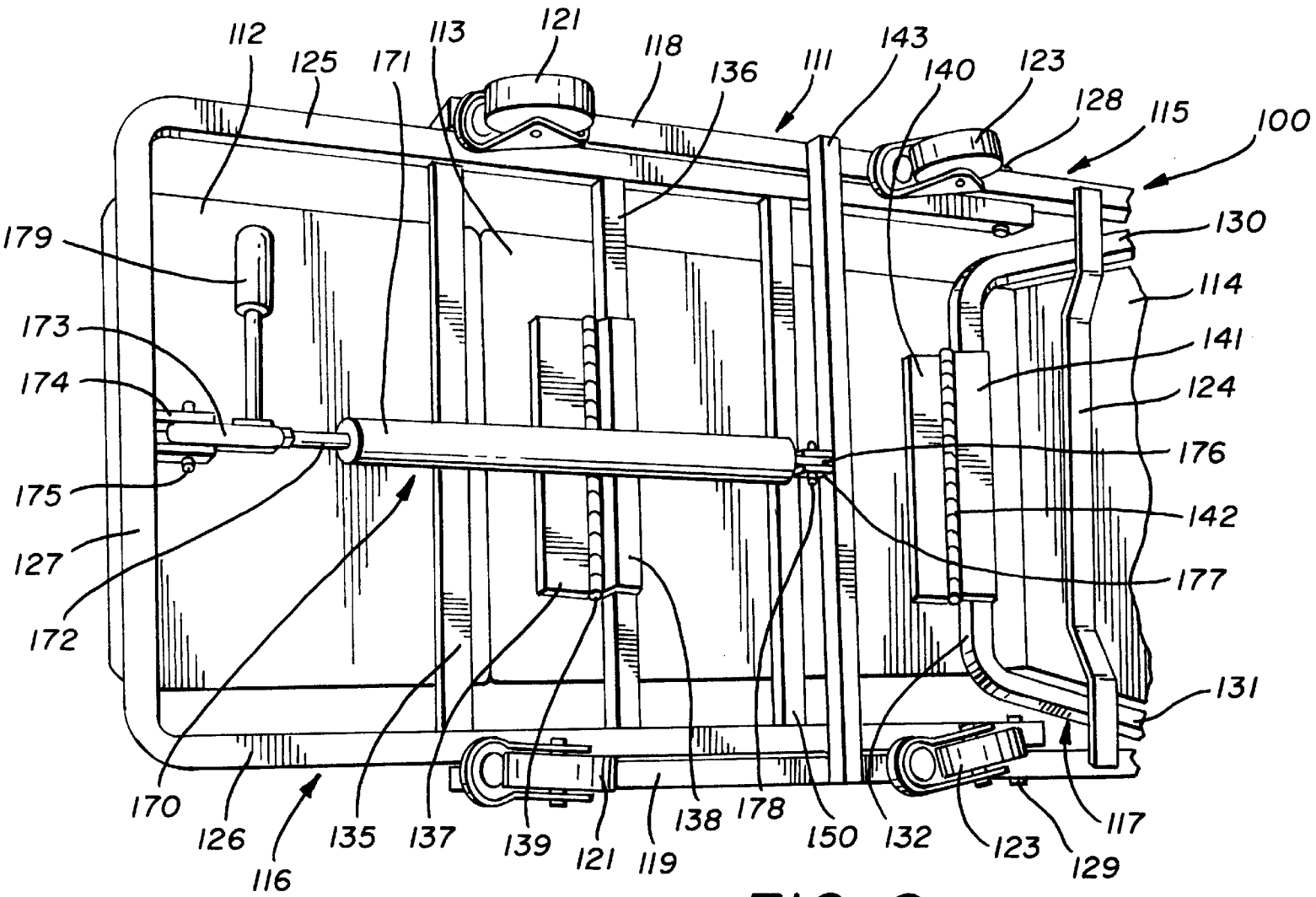
FIG. 8 is a fragmented bottom perspective view of the device of FIG. 7 shown in the full creeper configuration.

Another embodiment of a combined creeper and chair device is shown in FIGS. 7 and 8 and is indicated generally by the numeral 100. Creeper/chair 100 includes the same general structural elements as creeper/chair 10, and thus, those common elements have been given the same reference numerals in FIGS. 7 and 8 with a one-hundred prefix numeral. Thus, for example, creeper/chair 100 includes a support frame 115 (like support frame 15), a main pivotal frame 116 (like main pivotal frame 16), a secondary pivotal frame 117 (like secondary pivotal frame 17), and all of their associated members. The above description of the components of creeper/chair 10 therefore apply equally as well to the common components of creeper/chair 100 and will not be repeated herein.

Creeper/chair 100, however, does not include the latch assembly 44 and the locking assembly 51 of creeper/chair 10. Rather, creeper/chair 100 is provided with a position control assembly generally indicated by the numeral 170. Position control assembly 170 includes a device known in the art as a lockable gas cylinder, as will hereinafter be described. A device which is particularly suitable is one sold by Suspa, Incorporated of Grand Rapids, Mich., under the trademark VARILOCK and bearing Model No. HY3, the details of which are incorporated herein by reference.

Briefly describing the VARILOCK HY3 device, a cylinder 171 has a piston therein which separates a pneumatic medium from a hydraulic medium. A valve is positioned in the hydraulic medium to divide it into two chambers. The valve is carried by a rod 172 which extends out of one end of cylinder 171. The outer end of rod 172 is clevis connected to cross arm 127 of main pivot frame 116. To that end, a clevis rod end 173 is carried by rod 172 and is received by a yoke 174 attached to cross arm 127. Clevis rod end 173 is pin connected, as at 175, to yoke 174 thereby pivotally connecting position control assembly 170 to cross arm 127. The other end of cylinder 171 is likewise clevis connected to support beam 143 of support frame 115. To that end, a clevis rod end 176 is carried by cylinder 171 and is received by a yoke 177 attached to support beam 143. Clevis rod end 176 is pin connected, as at 178, to yoke 177 thereby pivotally connecting position control assembly 170 to support beam 143.

In the VARILOCK HY3 device, a release pin extends slidably, longitudinally within rod 172 and is connected at its inner end to the valve in the hydraulic medium within cylinder 171. The outer end of the release pin is connected to a control handle 179. The pivotal movement of handle 179 in a direction along the axis of rod 172 opens the valve and hydraulic fluid may then move from one chamber to the other within cylinder 171 which extends or retracts rod 172 until the handle 179 is released. This, for example, will cause creeper/chair 100 to move from the full creeper configuration shown in FIG. 8 toward the full chair configuration shown in FIGS. 3 and 4 of the first embodiment. However, should it be desired to configure creeper/chair 100 in some configuration intermediate of the full chair and full creeper configurations, such as shown in FIG. 7, handle 179 merely needs to be released at that time and creeper/chair 100 will be locked in that position as the valve in cylinder 171 is closed. In short, operation of position control assembly 170, as just described, enables the user to configure creeper/chair 100 in any position from the full creeper configuration to the full chair configuration with one simple manipulation of handle 179.

In view of the foregoing, it should be evident that a creeper/chair constructed and operated as described herein accomplishes the objects of the present invention and otherwise substantially improves the art.

What is claimed is:

1. A device transformable between full creeper and full chair configurations comprising a first frame, casters carried by said first frame to support said first frame, a second frame pivotally carried by said first frame, a third frame pivotally carried by said first frame, a pad, a first hinge assembly connecting said pad to said second frame, a second hinge assembly connecting said pad to said third frame, and means pivotally connected between said first and second frames to allow movement of said second frame relative to said first frame to configure the device anywhere from the full creeper configuration to the full chair configuration, such that as said second and third frames are pivoted relative to said first frame as the device is being transformed between the creeper and chair configurations, said pad is maintained in a generally horizontal position, and said casters continue to support said first frame in both the creeper and chair configurations.

2. A device according to claim 1 wherein said means includes a cylinder having one end pivotally connected to said first frame.

3. A device according to claim 2 wherein said means includes a rod extending outwardly from said cylinder and pivotally connected to said second frame.

4. A device according to claim 3 wherein said means includes second means attached to said rod to activate said means.

5. A device according to claim 4 wherein said second means includes a handle which upon movement moves said rod relative to said cylinder.

6. A device according to claim 5 whereby upon release of said handle, said means deactivates and said second frame will remain at a fixed position relative to said first frame.

7. A device transformable between full creeper and full chair configurations comprising a first frame, a second frame pivotally carried by said first frame, a third frame pivotally carried by said first frame, a pad, a first hinge assembly connecting said pad to said second frame, a second hinge assembly connecting said pad to said third frame, a second pad carried by said second frame, said second pad being in a generally horizontal position and constituting a headrest when the device is in the creeper configuration and being in a generally vertical position and constituting a backrest when the device is in the chair configuration, and means pivotally connected between said first and second frames to allow movement of said second frame relative to said first frame to configure the device anywhere from the full creeper configuration to the full chair configuration, such that as said second and third frames are pivoted relative to said first frame as the device is being transformed between the creeper and chair configurations, said pad is maintained in a generally horizontal position.

8. A device according to claim 7 further comprising a third pad carried by said first frame adjacent to said pad when the device is in the creeper configuration, a first pair of casters carried by said frame near one end of said third pad, and a second pair of casters carried by said first frame near the other end of said third pad and near one end of said pad when the device is in the creeper configuration, such that when the device is transformed to the chair configuration said pad is above said third pad and generally vertically, centrally located, over said first and second pairs of casters.

9. A device transformable between full creeper and full chair configurations comprising a first frame, a second frame pivotally carried by said first frame, a pad carried by said second frame, said pad being in a generally horizontal position and constituting a headrest when the device is in the creeper configuration and being in a generally vertical position and constituting a backrest when the device is in the chair configuration, a second pad carried by said second frame, a third pad carried by said first frame adjacent to said second pad when the device is in the creeper configuration, a first pair of casters carried by said first frame near the one end of said third pad, a second pair of casters carried by said first frame near the other end of said third pad and near one end of said second pad when the device is in the creeper configuration, such that when the device is transformed to the chair configuration said second pad is above said third pad and generally vertically, centrally located, over said first and second pairs of casters, and means pivotally connected between said first and second frames to allow movement of said second frame relative to said first frame to configure the device anywhere from the full creeper configuration to the full chair configuration.

10. A device transformable between creeper and chair configurations comprising a first frame, a second frame pivotally carried by said first frame, a third frame pivotally carried by said first frame, a pad having opposed ends, a first hinge assembly connecting said pad to said second frame, a second hinge assembly connecting said pad to said third frame, such that as said second and third frames are pivoted relative to said first frame as the device is being transformed between the creeper and chair configurations, said pad is maintained in a generally horizontal position, and a locking assembly extending between said first frame and said second frame, whereby upon pivotal movement of said second frame relative to said first frame when the device is being transformed from the creeper configuration to the chair configuration said locking assembly is adapted to automatically hold said second frame relative to said first frame so that the device is maintained in the chair configuration.

11. A device according to claim 10 wherein said locking assembly includes a first link arm having one end pivotally connected to said first frame, and a second link arm having one end pivotally connected to said second frame, the other ends of said link arms being pivotally connected to each other.

12. A device according to claim 11 wherein said locking assembly includes a tube positioned around said second link arm when the device is in the creeper configuration and automatically positioned around the pivotal connection of said other ends of said link arms when the device is in the chair configuration.

13. A device according to claim 12 wherein said first link arm includes a stop surface to engage said tube.

14. A device according to claim 13 wherein said locking assembly includes a spring positioned around said second link arm to urge said tube toward said stop surface.

15. A device according to claim 10 further comprising a latch assembly carried by said second frame, said latch assembly being adapted to automatically engage said first frame upon pivotal movement of said second frame relative to said first frame when the device is being transformed from the chair configuration to the creeper configuration so that the device is maintained in the creeper configuration.

16. A device according to claim 10 further comprising a second pad carried by said second frame, said second pad being in a generally horizontal position and constituting a headrest when the device is in the creeper configuration and being in a generally vertical position and constituting a backrest when the device is in the chair configuration.

17. A device according to claim 16 further comprising a third pad having opposed ends and carried by said first frame adjacent to said pad when the device is in the creeper configuration, a first pair of casters carried by said frame near one end of said third pad, and a second pair of casters carried by said first frame near the other end of said third pad and near one end of said pad when the device is in the creeper configuration, such that when the device is transformed to the chair configuration said pad is above said third pad and generally vertically, centrally located, over said first and second pairs of casters.

18. A device according to claim 10 further comprising a second pad having opposed ends and carried by said first frame adjacent to said pad when the device is in the creeper configuration, a first pair of casters carried by said frame near one end of said second pad, and a second pair of casters carried by said first frame near the other end of said second pad and near one end of said pad when the device is in the creeper configuration, such that when the device is transformed to the chair configuration said pad is above said second pad and generally vertically, centrally located, over said first and second pairs of casters.

19. A device transformable between creeper and chair configurations comprising a first frame, a second frame pivotally carried by said first frame, a first pad having opposed ends and carried by said second frame, a second pad having opposed ends and carried by said first frame adjacent to said first pad when the device is in the creeper configuration, a first pair of casters carried by said first frame near the one end of said second pad, a second pair of casters carried by said first frame near other end of said second pad and near one end of said first pad when the device is in the creeper configuration, such that when the device is transformed to the chair configuration said first pad is above said second pad and generally vertically, centrally located, over said first and second pairs of casters, and a locking assembly extending between said first frame and said second frame, whereby upon pivotal movement of said second frame relative to said first frame when the device is being transformed from the creeper configuration to the chair configuration said locking assembly is adapted to automatically hold said second frame relative to said first frame so that the device is maintained in the chair configuration.

20. A device transformable between creeper and chair configurations comprising a first frame, a second frame pivotally carried by said first frame and including an arm, and a latch assembly carried by said arm, said latch assembly being positioned within the profile of said arm and being adapted to automatically engage said first frame upon pivotal movement of said second frame relative to said first frame when the device is being transformed from the chair configuration to the creeper configuration so that the device is maintained in the creeper configuration.

21. A device according to claim 20 wherein said latch assembly includes a frame-engaging portion and a lug portion, said lug portion being adapted to flex to allow said frame-engaging portion to engage said frame as said second frame is pivoted toward said first frame.

22. A device according to claim 21 wherein said latch assembly further includes a grip area adapted to be flexed so as to allow the release of said frame-engaging portion from said frame upon pivotal movement of said second frame relative to said first frame.

23. A device according to claim 20 further comprising a third frame pivotally carried by said first frame, a pad, a first hinge assembly connecting said pad to said second frame, and a second hinge assembly connecting said pad to said third frame, such that as said second and third frames are pivoted relative to said first frame as the device is being transformed between the creeper and chair configurations, said pad is maintained in a generally horizontal position.

24. A device according to claim 23 further comprising a second pad carried by said second frame, said second pad being in a generally horizontal position and constituting a headrest when the device is in the creeper configuration and being in a generally vertical position and constituting a backrest when the device is in the chair configuration.

25. A device according to claim 20 further comprising a pad carried by said second frame, said pad being in a generally horizontal position and constituting a headrest when the device is in the creeper configuration and being in a generally vertical position and constituting a backrest when the device is in the chair configuration.

26. A device according to claim 25 further comprising a second pad having opposed ends and carried by said second frame, a third pad having opposed ends and carried by said first frame adjacent to said second pad when the device is in the creeper configuration, a first pair of casters carried by said first frame near one end of said third pad, and a second pair of casters carried by said first frame near the other end of said third pad and near one end of said second pad when the device is in the creeper configuration, such that when the device is transformed to the chair configuration said second pad is above said third pad and generally vertically, centrally located, over said first and second pairs of casters.

27. A device according to claim 20 further comprising a first pad having opposed ends and carried by said second frame, a second pad having opposed ends and carried by said first frame adjacent to said first pad when the device is in the creeper configuration, a first pair of casters carried by said first frame near one end of said second pad, and a second pair of casters carried by said first frame near the other end of said second pad and near one end of said first pad when the device is in the creeper configuration, such that when the device is transformed to the chair configuration said first pad is above said second pad and generally vertically, centrally located, over said first and second pairs of casters.

28. A device according to claim 27 further comprising a third frame pivotally carried by said first frame, a first hinge assembly connecting said first pad to said second frame, and a second hinge assembly connecting said first pad to said third frame, such that as said second and third frames are pivoted relative to said first frame as the device is being transferred between the creeper and chair configurations, said first pad is maintained in a generally horizontal position.

29. A device according to claim 28 further comprising a third pad carried by said second frame, said third pad being in a generally horizontal position and constituting a headrest when the device is in the creeper configuration and being in a generally vertical position and constituting a backrest when the device is in the chair configuration.

30. A device transformable between creeper and chair configurations comprising a support frame, a first pivot frame pivotally connected to said support frame, a second pivot frame pivotally connected to said support frame, a pad having opposed ends, a second pad carried by said first pivot frame and not connected to said pad, said second pad being in a generally horizontal position and constituting a headrest when the device is in the creeper configuration and being in a generally vertical position and constituting a backrest when the device is in the chair configuration, a first hinge assembly connecting said pad to said first pivot frame, and a second hinge assembly connecting said pad to said second pivot frame, such that as said pivot frames are pivoted relative to said support frame as the device is being transformed between the creeper and chair configurations, said pad is maintained in a generally horizontal position.

31. A device according to claim 30 further comprising a third pad having opposed ends and carried by said support frame and being adjacent to said pad when the device is in the creeper configuration, a first pair of casters carried by said support frame near one end of said third pad, and a second pair of casters carried by said support frame near the other end of said third pad and near one end of said pad when the device is in the creeper configuration, such that when the device is transformed to the chair configuration, said pad is above said third pad and generally vertically, centrally located, over said first and second pair of casters.

32. A device transformable between creeper and chair configurations comprising a first frame, a second frame pivotally carried by said first frame, a first pad carried by said second frame, a second pad having opposed ends and carried by said second frame, said second pad being positioned adjacent to said first pad in the creeper configuration and not connected to said first pad, a third pad having opposed ends and carried by said first frame, said third pad being positioned adjacent to said second pad in the creeper configuration and not connected to said second pad, said first pad being in a generally horizontal position and constituting a headrest when the device is in the creeper configuration and being in a generally vertical position and constituting a backrest when the device is in the chair configuration, said second pad being in a generally horizontal position in both the creeper and chair configurations and being above said third pad to constitute a seat in the chair configuration.

33. A device according to claim 32 further comprising a first pair of casters carried by said first frame near one end of said third pad, and a second pair of casters carried by said first frame near the other end of said third pad and near one end of said second pad when the device is in the creeper configuration, such that when the device is transformed to the chair configuration said second pad is generally vertically, centrally located, over said first and second pairs of casters.

34. A device transformable between creeper and chair configurations comprising support framework, a first pad having opposed ends and carried by said framework, a second pad having opposed ends and carried by said framework adjacent to said first pad when the device is in the creeper configuration, a first pair of casters carried by said framework near one end of said second pad, and a second pair of casters carried by said framework near the other end of said second pad and generally adjacent to one end of said first pad when the device is in the creeper configuration, such that when the device is transformed to the chair configuration, said first pad is generally horizontally located above said second pad and said first and second pads are generally vertically, centrally located, over said first and second pairs of casters.

35. A device according to claim 34 further comprising a third pair of casters carried by said framework near the other end of said first pad when the device is in the creeper configuration.

36. A device according to claim 34 further comprising a third pad having opposed ends and carried by said framework, said third pair of casters being positioned near one end of said third pad when the device is in the creeper configuration.

37. A device according to claim 36 wherein said framework includes a support frame, a first pivotal frame, and a second pivotal frame, said second pad and all said pairs of casters being carried by said support frame, said first pad being carried by said first and second pivotal frames, and said third pad being carried by said first pivotal frame.

38. A device transferable between creeper and chair configurations comprising a support frame; a first pivot frame pivotally carried by said support frame; a second pivot frame pivotally carried by said support frame; a locking assembly extending between said support frame and said first pivot frame, said locking assembly automatically maintaining the device in the chair configuration; a latch assembly carried by said first pivot frame, said latch assembly automatically maintaining the device in the creeper configuration; a first pad carried by said first pivot frame, such that said first pad is in a generally horizontal position to constitute a headrest when the device is in the creeper configuration and being in a generally vertical position to constitute a backrest when the device is in the chair configuration; a second pad having opposed ends and carried by said support frame; a third pad having opposed ends hinge connected to said first pivot frame and to said second pivot frame to maintain said third pad in a generally horizontal position both in the creeper and chair configurations, said third pad being adjacent to said second pad when the device is in the creeper configuration; a first pair of casters carried by said support frame near one end of said second pad; and a second pair of casters carried by said support frame near the other end of said second pad and near one end of said third pad when the device is in the creeper configuration; such that when the device is transformed to the chair configuration, said third pad is above said second pad and generally vertically, centrally located, over said first and second pairs of casters.

* * * * *